US009321300B2

(12) United States Patent
Parker

(10) Patent No.: US 9,321,300 B2
(45) Date of Patent: Apr. 26, 2016

(54) CAP WITH CLASP PERMANENTLY ATTACHED

(71) Applicant: Melissa Parker, Hesperia, CA (US)

(72) Inventor: Melissa Parker, Hesperia, CA (US)

( * ) Notice: Subject to any disclaimer, the term of this patent is extended or adjusted under 35 U.S.C. 154(b) by 96 days.

(21) Appl. No.: 14/179,130

(22) Filed: Feb. 12, 2014

(65) Prior Publication Data

US 2015/0224817 A1 Aug. 13, 2015

(51) Int. Cl.
*B44F 99/00* (2013.01)
*A44B 1/04* (2006.01)

(52) U.S. Cl.
CPC .. *B44F 99/00* (2013.01); *A44B 1/04* (2013.01)

(58) Field of Classification Search
USPC ..... 215/316; 224/148.1
See application file for complete search history.

(56) References Cited

U.S. PATENT DOCUMENTS

| | | | | |
|---|---|---|---|---|
| D200,447 | S * | 2/1965 | Lermer | D9/443 |
| 3,240,384 | A * | 3/1966 | Lermer | 220/780 |
| D226,839 | S * | 5/1973 | Jennings | D9/436 |
| 4,055,266 | A * | 10/1977 | Amabili | 215/252 |
| 7,048,137 | B2 * | 5/2006 | Leoncavallo et al. | 220/288 |
| 2006/0011125 | A1 * | 1/2006 | Polly | B42D 9/002 116/234 |
| 2007/0031613 | A1 * | 2/2007 | Foster, II | A47G 33/08 428/7 |
| 2013/0200035 | A1 * | 8/2013 | Wilson | 215/316 |

* cited by examiner

*Primary Examiner* — Anthony Stashick
*Assistant Examiner* — Raven Collins
(74) *Attorney, Agent, or Firm* — Fish & Richardson P.C.

(57) ABSTRACT

A crown cap having a clasp permanently attached to a top wall of the crown cap. The crown cap has a top wall having a substantially planar surface, a depending peripheral flange, the flange having a plurality of ribs and a plurality of webs interconnecting the ribs, and a clasp permanently attached to the surface of the top wall wherein the clasp attached to the top wall forms an opening through which material can be passed to secure the crown cap to an item.

20 Claims, 6 Drawing Sheets

CAP WITH CLASP PERMANENTLY ATTACHED

TECHNICAL FIELD

This specification relates to crown caps, and more particularly to the use of crown caps in crafting projects.

BACKGROUND

Crown caps are commonly-used bottle caps that are often used for artistic purposes. Crown caps are used to add creative flair to bows, clothes, purses, and other craft projects. The caps are generally affixed to other materials by using glue or other adhesive, or by punching holes in the crown cap in order to sew the cap to fabric or thread ribbon through the holes. While these methods allow the cap to be attached to a project, adhesives are messy and can detach from other materials under certain humidity and temperature conditions. Punching holes in the cap alters the appearance and structural integrity of the cap.

SUMMARY

This specification describes a crown cap having a clasp permanently attached. In general, one innovative aspect of the subject matter described in this specification can be embodied in a crown cap for crafting projects that includes a top wall comprising a substantially planar a depending peripheral flange, the flange having a plurality of ribs and a plurality of webs interconnecting the ribs; and a clasp permanently attached to the top wall wherein the clasp attached to the top wall forms an opening through which material can be passed through to secure the crown cap to an item.

The foregoing and other embodiments can each optionally include one or more of the following features, alone or in combination. The clasp is formed from a rigid material. The clasp is formed from a flexible material. The peripheral flange extends away from the top wall at least partially in a first direction along an axis that is perpendicular to a plane formed by the top wall. The clasp extends away from the top wall at least partially in the first direction along the axis. The clasp extends away from the top wall at least partially in a second direction opposite the first direction along the axis. A distance that the peripheral flange extends in a direction perpendicular to a plane defined by the top wall exceeds a distance that the clasp attached to the top wall extends along the axis. A distance that the peripheral flange extends in a direction perpendicular to a plane defined by the top wall does not exceed a distance that the clasp attached to the top wall extends along the axis. The crown cap is a metallic crown cap. The top wall is forms a substantially circular surface. The clasp is attached to the top wall in at least two places. The crown cap is a flattened bottle cap. The clasp is a ring of metal attached to the top wall in one place.

In general, another innovative aspect of the subject matter described in this specification can be embodied in methods for attaching a crown cap to an item that include the actions of passing a strip of material through an opening formed by a clasp that is permanently attached to a top wall of the crown cap in at least two places, wherein the top wall has a depending peripheral flange, the flange configured to form a plurality of ribs and a plurality of webs interconnecting the ribs; and attaching the crown cap to the item by securing the material to the item. The foregoing and other embodiments can each optionally include one or more of the following features, alone or in combination. Attaching the crown cap to the item by securing the material to the item comprises sewing the material to the item. Attaching the crown cap to the item by securing the material to the item comprises tying the material to the item. The item is a hair bow, a hair clip, a headband, a chain, a zipper pull, or a keychain. The clasp is permanently attached to the top wall of the crown cap in at least two places. The crown cap is a flattened bottle cap. The clasp is a ring of metal attached to the top wall in one place.

The details of one or more embodiments of the subject matter of this specification are set forth in the accompanying drawings and the description below. Other features, aspects, and advantages of the subject matter will be apparent from the description, the drawings, and the claims.

BRIEF DESCRIPTION OF THE DRAWINGS

Like reference symbols in the various drawings indicate like elements.

DETAILED DESCRIPTION

Figure 1A:
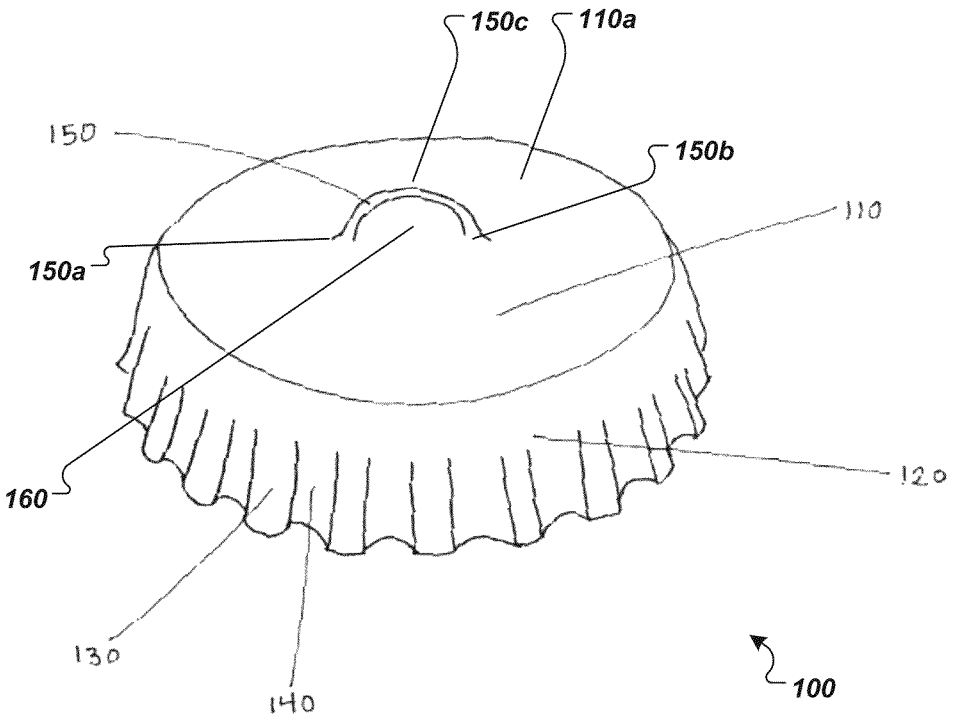
FIG. 1A is a perspective view of an example of a crown cap.
Figure 1B:
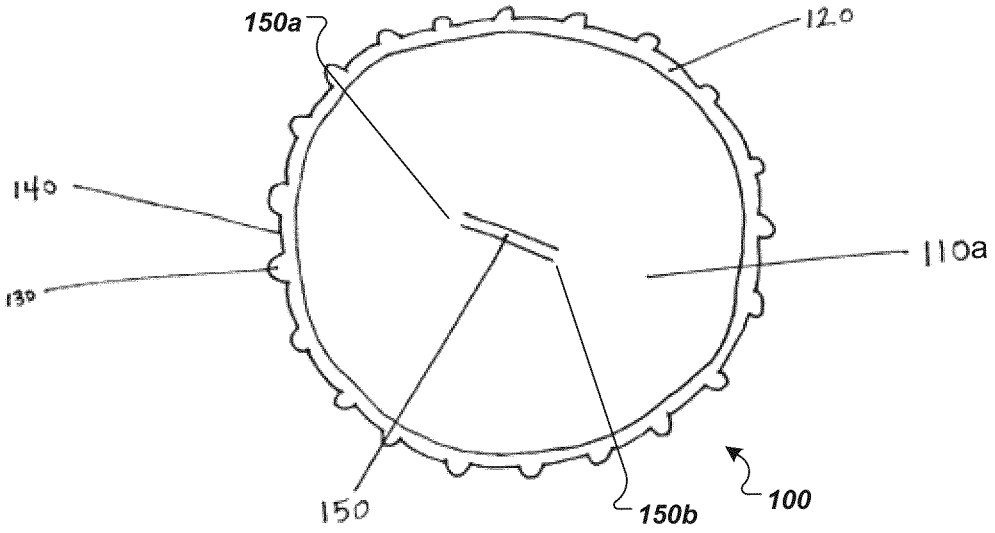
FIG. 1B is a top view of the crown cap of FIG. 1A.
Figure 1C:
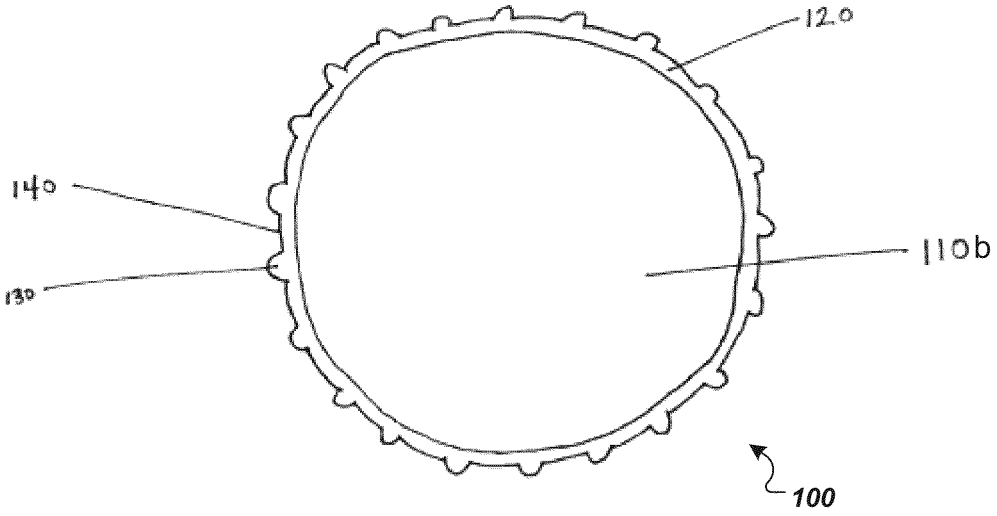
FIG. 1C is a bottom view of the crown cap of FIG. 1A.
Figure 1D:
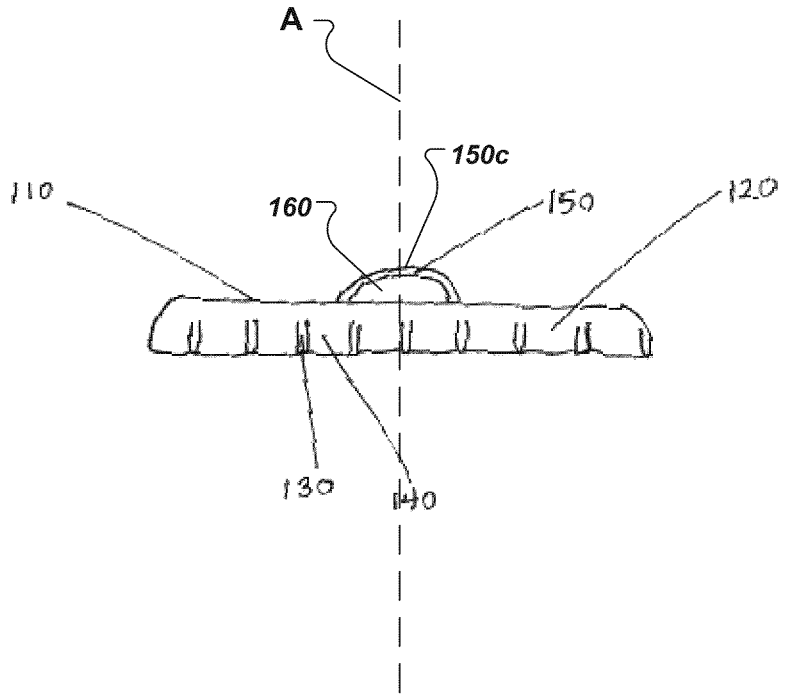
FIG. 1D is a side view of the crown cap of FIG. 1A.

In various embodiments, a crown cap includes a clasp permanently connected to a top wall of the cap. The clasp can be attached to either the inner or outer surface of the top wall. In certain instances, the attached clasp may allow the cap to be sewn onto fabric, strung on ribbon or string, or attached to other materials. The clasp may allow the cap to be attached to various materials without adhesive and without punching holes in the cap.

FIGS. 1A-1D illustrate an example of a crown cap 100. The crown cap 100 includes a substantially circular top wall 110 with a first side 110*a* and a second side 110*b*, a peripheral flange 120 extending from the top wall 110, and a clasp 150. The top wall 110, peripheral flange 120, and clasp 150 are each made from the same or a different material. For example, the top wall, 110, peripheral flange 120, and clasp 150 are made from a metal, such as aluminum, brass, stainless steel, or mild steel.

The peripheral flange 120 connects to the top wall 110 along the circumference of the top wall 110. The peripheral flange 120 extends away from the top wall 110 at least partially in a first direction along an axis A that is perpendicular to a plane formed by the top wall 110. Thus, the peripheral flange can be part of a bottle cap or a flattened bottle cap, to name just a few examples. The peripheral flange 120 extends from the top wall 110 at an angle between forty-five and ninety degrees from the plane of the top wall 110. The angle between the peripheral flange 120 and the top wall 110 remains substantially uniform along the length of the peripheral flange 120.

The peripheral flange 120 includes a plurality of ribs 130 and a plurality of interconnecting webs 140. The ribs 130 and interconnecting webs 140 may extend along the entire circumference of the peripheral flange 120.

The clasp 150 is attached to the first side 110*a* of the top wall 110 in approximately the center of the first side 110*a*. In particular, the clasp 150 includes a first end 150*a* attached to the first side 110*a*, a second end 150*b* attached to the first side 110*a*, and a connecting portion 150*c* that connects the first end 150*a* and the second end 150*b*. The first end 150*a*, second end 150*b*, and connecting portion 150*c* are positioned on the top wall 110 such that a central axis extending perpendicular to and through a center of the top wall 110 bisects the clasp 150.

The connecting portion 150*c* is curved and forms a U-shape that extends in a second direction, which is opposite the first direction, along the axis A. The connecting portion 150*c* defines an opening or space 160 between the connecting portion 150*c* and the first side 110*a* of the top wall 110. The space 160 is large enough for material to pass through the opening. The material can be, for example, ribbon, cloth, thread, elastic, or any other appropriate material.

Although shown as being connected to the top wall 110 in two places, the clasp 150 can also be attached to the top wall 110 in one place. For example, the clasp 150 may be a ring or an ellipse of material that is connected to the top wall 110 in one place.

The clasp 150 can be attached to the crown cap 100 as part of an integrated manufacturing process of the crown cap 100. The clasp 150 can also be welded, soldered, or glued onto the crown cap 100. The clasp 150 can be formed using any appropriate type of metal, or another appropriate flexible material, e.g., plastic, rubber, or silicone.

Figure 2:
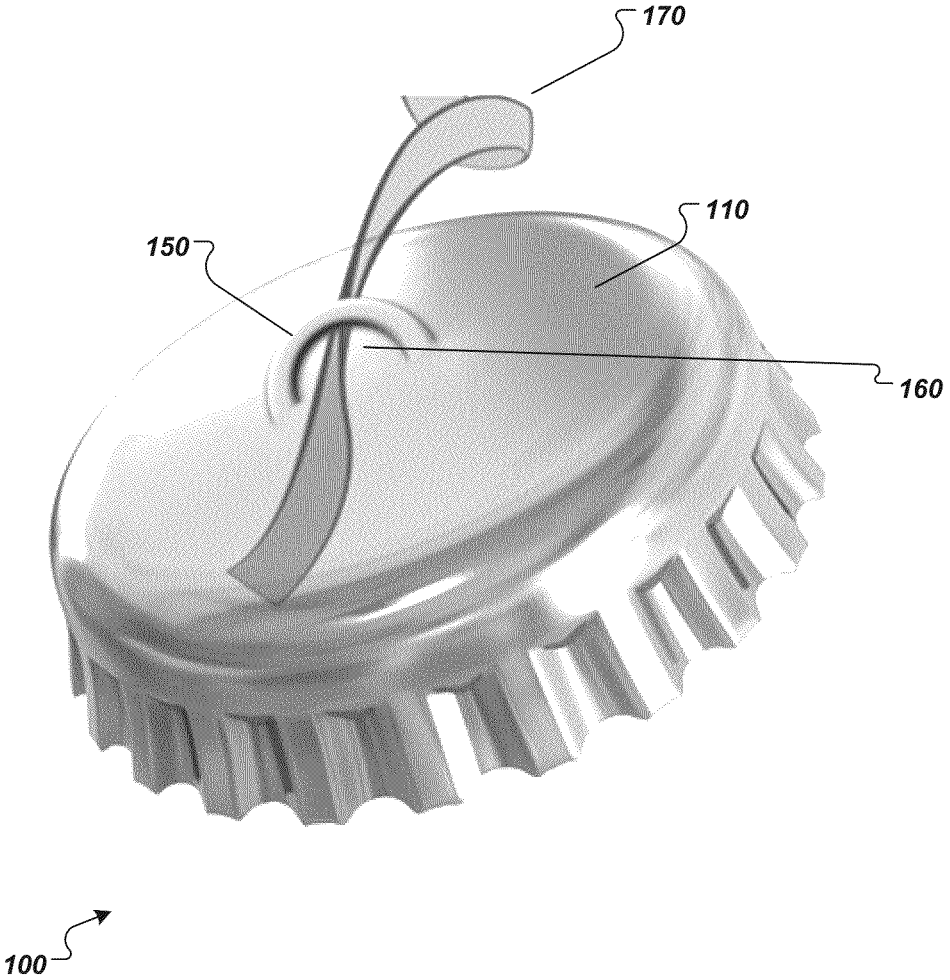
FIG. 2 is a diagram that illustrates attaching the crown cap of FIG. 1A to a piece of ribbon.

FIG. 2 is a diagram that illustrates attaching the crown cap 100 to a piece of ribbon 170. The ribbon 170 passes through an opening 160 formed between the clasp 150 and the top wall 110. The ribbon can be tied to secure the crown cap 100 to the ribbon or another item, e.g., a hair bow. The crown cap 100 can also be sewed to the ribbon by passing thread through the opening 160 between the clasp 150 and the top wall 110. The crown cap 100 can also be attached or sewed to any other type of material. For example, the crown cap 100 can be sewed onto clothing.

Figure 3A:
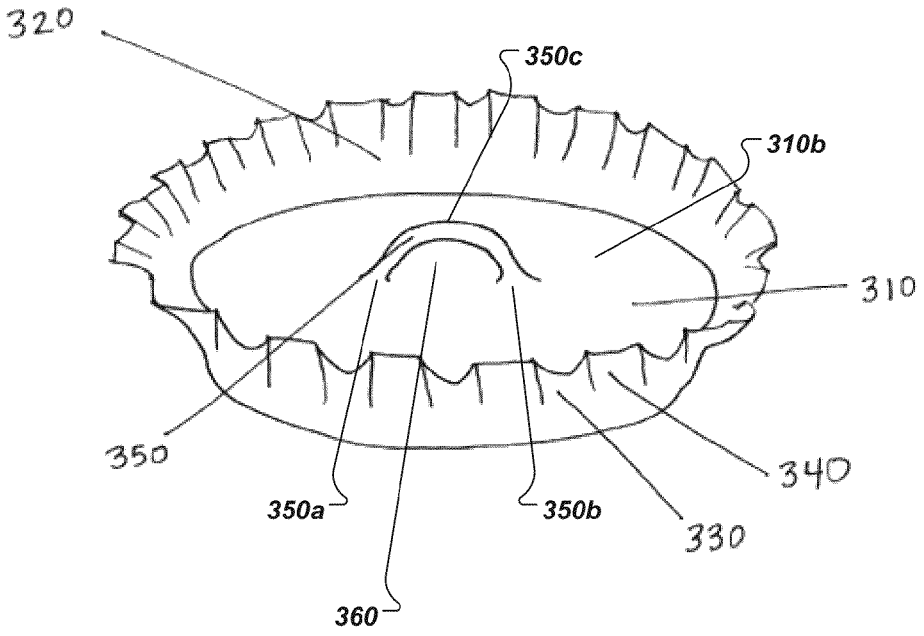
FIG. 3A is a perspective view of another example of a crown cap.
Figure 3B:
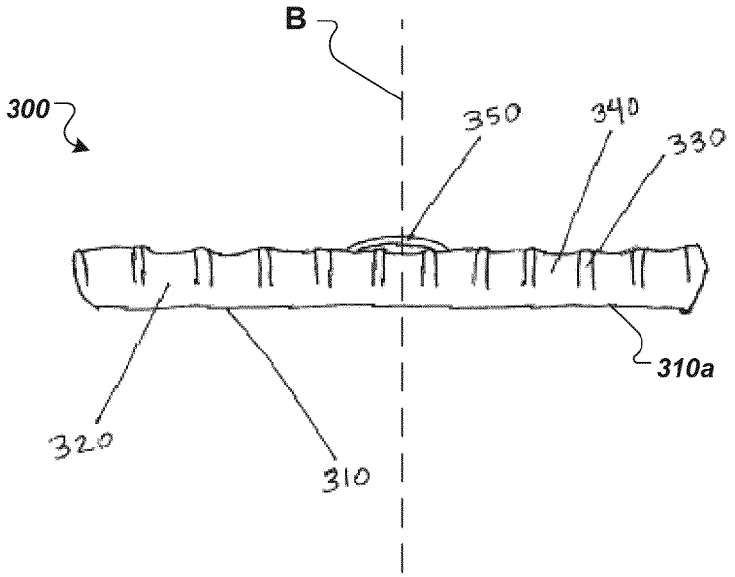
FIG. 3B is a side view of the crown cap of FIG. 3B.

The material to which the crown cap 100 is attached, e.g. ribbon, can also be used to attach the crown cap to other materials. For example, the crown cap 100 can be attached to the ribbon 170, and the ribbon 170 can be attached to clothing, hair clips, hair bows, headbands, hair accessories, jewelry, beads, chains, zipper pulls, and keychains. The crown cap 100 can be attached by being tied or sewn on. The crown cap 100 can also be weaved in with beading on a string or on a chain. FIG. 3A-3B illustrate another example of a crown cap 300. The crown cap 300 includes a substantially circular top wall 310 with a first side 310*a* and a second side 310*b*, a peripheral flange 320 extending from the top wall 310, and a clasp 350.

The peripheral flange 320 includes a plurality of ribs 330 and a plurality of interconnecting webs 340. The peripheral flange 320 connects to the top wall 310 along the circumference of the top wall 310. The peripheral flange 320 extends away from the top wall 110 at least partially in a first direction along an axis B that is perpendicular to a plane formed by the top wall 310.

The clasp 350 can be have similar properties to the clasp 150 as described above, but the clasp 350 is attached to the crown cap 300 in in the same first direction as a direction of extension of the peripheral flange 320.

The clasp 350 is attached to the second side 310*b* of the top wall 310 in approximately in approximately the center of the second side 310*b*. The clasp 350 includes a first end 350*a* attached to the second side 310*b*, a second end 350*b* attached to the second side 310*b*, and a connection portion 350*c* that connects the first end 350*a* and the second end 350*b*. The first end 350*a*, second end 350*b*, and connection portion 350*c* are positioned on the top wall 310 such that a central axis extending perpendicular to and through a center of the top wall 310 bisects the clasp 350.

The connecting portion 350*c* is curved and extends in a first direction along the axis B. The connecting portion 350*c* defines an opening or space 360 between the connecting portion 350*c* and the second side 310*b* of the top wall 310. The space 360 is large enough for material to pass through the opening.

The clasp 350 may also have additional attachment points to the plane of the top wall 310, thereby forming additional openings.

In FIG. 3B, the clasp 350 extends in a direction along the axis B and extends beyond the extension of the peripheral flange 320. However, the clasp 350 can alternatively have a size such that the clasp 350 does not extend beyond the extension of of peripheral flange 320, which can allow the crown cap 300 to be attached more securely to material.

Figure 4:
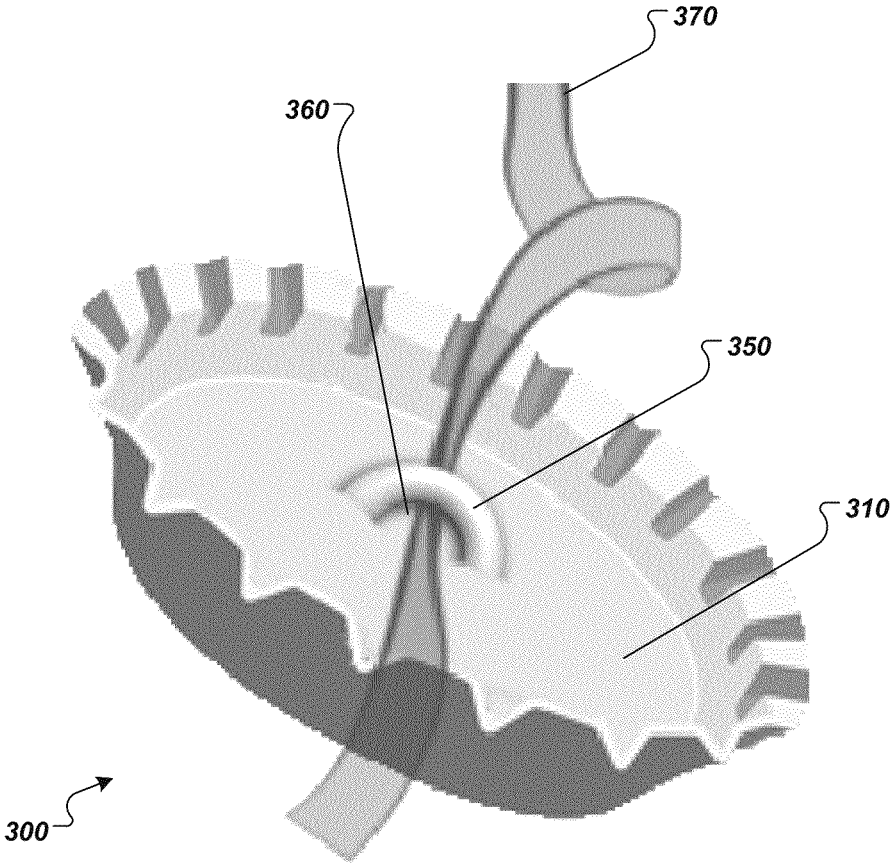
FIG. 4 is a diagram that illustrates attaching the crown cap of FIG. 3B to a piece of ribbon.

FIG. 4 is a diagram that illustrates attaching the crown cap 300 to a piece of ribbon 370. The ribbon 370 passes through an opening 360 formed between the clasp 350 and the top wall 310. After passing the ribbon 370 through the opening, the crown cap 300 can be secured to any appropriate material, e.g., by tying or sewing the crown cap 300 to the material.

A number of embodiments have been described. Nevertheless, it will be understood that various modifications may be made without departing from the spirit and scope of the invention. For example, more than one clasp could be attached to the cap, in a variety of different configurations. The clasps 150 and 350 are illustrated as a rigid "U"-shaped device, but the clasps 150 or 350 can have a number of other styles, shapes, and sizes. In addition, the clasps 150 and 350 are permanently attached in roughly the center of the top wall of the crown cap, but the clasps 150 or 350 can be attached to other appropriate positions of the top wall of the crown cap. Moreover, the clasps 150 and 350 extend perpendicular from the plane of the top wall, but can alternatively be attached at any appropriate angle between 0 and 90 degrees, e.g., 45 degrees, from the plane of the top wall.

Accordingly, other embodiments are within the scope of the following claims.

What is claimed is:

1. A crown cap for crafting projects comprising:

a top wall comprising a substantially planar surface;

a depending peripheral flange, the flange having a plurality of ribs and a plurality of webs interconnecting the ribs, wherein the peripheral flange extends away from the top wall at least partially in a first direction along an axis that is perpendicular to a plane formed by the top wall; and a clasp permanently attached to the surface of the top wall wherein the clasp attached to the top wall forms an opening through which material can be passed to secure the crown cap to an item, wherein the clasp extends away from the top wall at least partially in the first direction along the axis.

2. The crown cap of claim 1, wherein the clasp is formed from a rigid material.

3. The crown cap of claim 1, wherein the clasp is formed from a flexible material.

4. The crown cap of claim 1, wherein a distance that the peripheral flange extends in a direction perpendicular to a plane defined by the top wall exceeds a distance that the clasp attached to the top wall extends along the axis.

5. The crown cap of claim 1, wherein a distance that the peripheral flange extends in a direction perpendicular to a plane defined by the top wall does not exceed a distance that the clasp attached to the top wall extends along the axis.

6. The crown cap of claim 1, wherein the crown cap is a metallic crown cap.

7. The crown cap of claim 1, wherein the top wall comprises a substantially circular surface.

8. The crown cap of claim 1, wherein the clasp is attached to the top wall in at least two places.

9. The crown cap of claim 1, wherein the crown cap is a flattened bottle cap.

10. The crown cap of claim 1, wherein the clasp is a ring of metal attached to the top wall in one place.

11. A method for attaching a crown cap to an item comprising:

passing a strip of material through an opening formed by a clasp that is permanently attached to a top wall of the crown cap, wherein the top wall has a depending peripheral flange, the flange configured to form a plurality of ribs and a plurality of webs interconnecting the ribs, wherein the peripheral flange extends away from the top wall at least partially in a first direction along an axis that is perpendicular to a plane formed by the top wall, and wherein the clasp extends away from the top wall at least partially in the first direction along the axis; and attaching the crown cap to the item by sewing the material to the item.

12. The method of claim 11, wherein the attaching the crown cap to the item includes attaching the crown cap to a hair bow, a hair clip, a headband, a chain, a zipper pull, or a keychain.

13. The method of claim 11, wherein the passing a strip of material through an opening formed by a clasp includes passing the strip of material through an opening formed by a clasp that is permanently attached to the top wall of the crown cap in at least two places.

14. The method of claim 11, wherein the passing a strip of material through an opening formed by a clasp includes passing the strip of material through an opening formed by a clasp that is permanently attached to a top wall of a flattened bottle cap.

15. The method of claim 11, wherein the passing a strip of material through an opening formed by a clasp includes passing the strip of material through an opening formed by a clasp that is a ring of metal attached to the top wall in one place.

16. A method for attaching a crown cap to an item comprising:

passing a strip of material through an opening formed by a clasp that is permanently attached to a top wall of the crown cap, wherein the top wall has a depending peripheral flange, the flange configured to form a plurality of ribs and a plurality of webs interconnecting the ribs, wherein the peripheral flange extends away from the top wall at least partially in a first direction along an axis that is perpendicular to a plane formed by the top wall, and wherein the clasp extends away from the top wall at least partially in the first direction along the axis; and attaching the crown cap to the item by tying the material that passes through the opening formed by the clasp to the item.

17. The method of claim 16, wherein the attaching the crown cap to the item includes attaching the crown cap to a hair bow, a hair clip, a headband, a chain, a zipper pull, or a keychain.

18. The method of claim 16, wherein the passing a strip of material through an opening formed by a clasp includes passing the strip of material through an opening formed by a clasp that is permanently attached to the top wall of the crown cap in at least two places.

19. The method of claim 16, wherein the passing a strip of material through an opening formed by a clasp includes passing the strip of material through an opening formed by a clasp that is permanently attached to a top wall of a flattened bottle cap .

20. The method of claim 16, wherein the passing a strip of material through an opening formed by a clasp includes passing the strip of material through an opening formed by a clasp that is a ring of metal attached to the top wall in one place.

* * * * *